US005231672A

United States Patent [19]

Tsao

[11] Patent Number: 5,231,672

[45] Date of Patent: Jul. 27, 1993

[54] PLANE-SURFACED WAVED OUT-DIFFUSION TRIANGULAR BEAM-TYPED RESONANT BOARD

[76] Inventor: Ye-Ming Tsao, Rm No. 6-11, 6/F., No. 782 Ting Chou Rd., Taipei, Taiwan

[21] Appl. No.: 726,701

[22] Filed: Jul. 8, 1991

[51] Int. Cl.[5] ..... H04R 25/00

[52] U.S. Cl. ..... 381/153; 381/202; 381/203

[58] Field of Search ..... 381/202, 203, 152, 153; 29/594, 609.1

[56] References Cited

U.S. PATENT DOCUMENTS

| | | | |
|---|---|---|---|
| 4,272,653 | 6/1981 | Osato et al. | 381/203 |
| 4,322,583 | 3/1982 | Maeda | 381/202 |
| 4,472,604 | 9/1984 | Nakamura et al. | 381/203 |
| 4,517,416 | 5/1985 | Goossens | 381/203 |

FOREIGN PATENT DOCUMENTS

| | | | |
|---|---|---|---|
| 0241498 | 10/1987 | Japan | 381/202 |

*Primary Examiner*—Jin F. Ng
*Assistant Examiner*—Huyen D. Le
*Attorney, Agent, or Firm*—Bacon & Thomas

[57] ABSTRACT

A waved out-diffusion triangular beam-typed resonant board includes a resonant board body, an upper board, a lower board and a paper bobbin. The resonant board body is formed by pressing with waves diffusing outwards horizontally at close intervals from its center and having, connection between peak and valley in straight line. The upper board is adhered to the to and the lower board is adhered to the bottom of the resonant board body so that application of force from the top or bottom will not deform or bend the resonant board. The paper bobbin is adhered to a round hole at the center of the resonant board body. Since vibration will apply a force at the top and bottom of the resonant board, but the resonant board body has a strength to withstand the vibration without any deformation the requirement for a good thin-type low frequency speaker are met.

2 Claims, 4 Drawing Sheets

PLANE-SURFACED WAVED OUT-DIFFUSION TRIANGULAR BEAM-TYPED RESONANT BOARD

BACKGROUND OF THE INVENTION

The present invention relates to a plane-surfaced waved out-diffusion triangular beam-typed resonant board, particularly a low-costed and easy to produce resonant board having a strength to withstand vibration without deformation.

A resonant board is a component for changing a tone by changing strength of sound, and hence a good speaker requires a sufficient resonant board strength to withstand vibration without deformation.

Conventionally the resonant board for a speaker has a voice coil adhered to the middle. Vibration can deform the voice coil. Moreover, for a low frequency speaker, the larger the diameter, the thicker the speaker. Though there has been a so-called "cellular type plane-surfaced speaker" in the market, it was developed in Japan and the U.S. for another purpose. It is a light and high pressure resistant plane surfaced board and is not particularly designed for use as speaker. Its production is difficult, and its production cost is very high. Moreover, a conical structure has to be adhered to the cellular type plane-surfaced board for connection to a coil, which means that it is not suitable for making a thin-type low frequency speaker because of its height.

SUMMARY OF THE INVENTION

The main objective of the present invention is to provide a plane-surfaced waved out-diffusion triangular beam-typed resonant board formed with waves diffusing outwards from its center horizontally at close intervals, and adhered with an upper board at the top, a lower board at the bottom to provide the strength to withstand upward and downward vibration without deformation.

Another objective of the present invention is to provide a low-cost and easy to produce plane-surfaced waved out-diffusion triangular beam-typed resonant board with upper and lower boards to provide additional strength to meet requirements for a good low frequency speaker.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
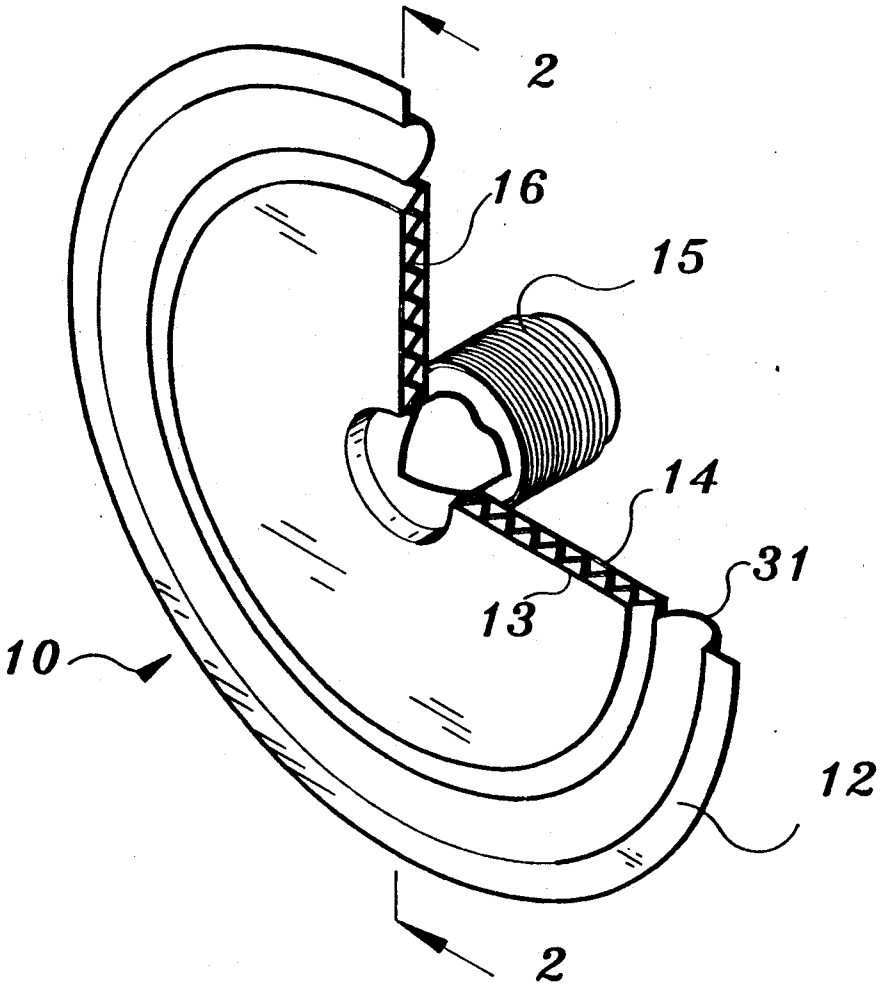
FIG. 1 is a partial sectional perspective view of a preferred embodiment according to the present invention.
Figure 2:
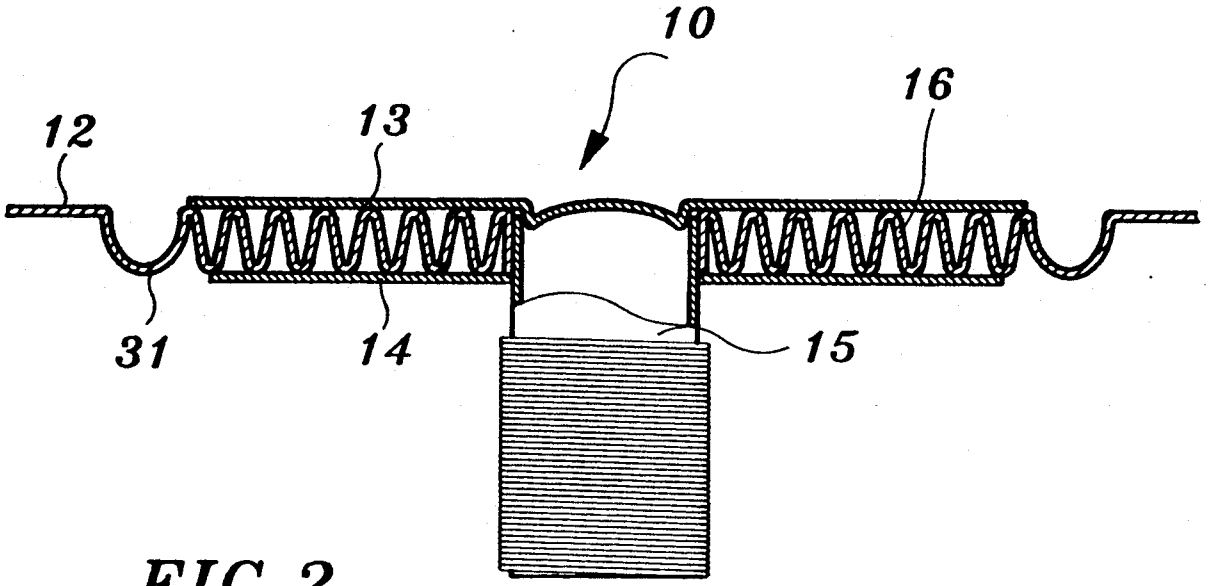
FIG. 2 is a sectional view of the preferred embodiment taken along the line 2—2 in FIG. 1.

Please refer to FIGS. 1 and 2, the plane-surfaced waved out-diffusion triangular beam-typed resonant board (10) according to the present invention comprises mainly a resonant board body (12), an upper board (13), a lower board (14), and a paper bobbin (15). The resonant board body (12) is formed by pressing with waves (16) diffusing outwards at close intervals horizontally from its center in a curve of sinusoidal wave or square wave. Connection between peaks and valleys in straight lines is recommendable in order to maintain its strength. Wave length, wave height, and width of peak and valley are subject to the strength of material used, and depend on limits in strength and weight. The upper board (13) is adhered to the top and the lower board (14) is adhered to the bottom of the resonant board body (12) in a way that any side extending from the center is just like a triangular beam, and application of force from the top or bottom will not deform or bend the resonant board according to the present invention. Since vibration will occur mainly a the soft circular cavity (31) at the edge of both the upper board (13) and the lower board (14), and the paper bobbin (15) is adhered as shown in FIG 2 to the center of the resonant board body (12), the vibration will apply a force at the top and bottom of the resonant board (10), and the resonant board body (12) has the strength to withstand the vibration without any deformation—a requirement for a good thin-type low frequency speaker. The present invention is a design which overcomes the defects in the conventional speaker. In contrast although there has been a so-called "cellular type plane-surfaced speaker" in the market, the prior device was developed in Japan and the US for another, purpose, is a light and high pressure resistant plane-surfaced board was not particularly designed for use as a speaker, is difficult, to produce and has a very high production cost. Moreover, a conical structure has to be adhered to the prior cellular type plane-surfaced board for connection to a coil, which means that it is not suitable for making of thin-type speaker because of its height.

Figure 3:
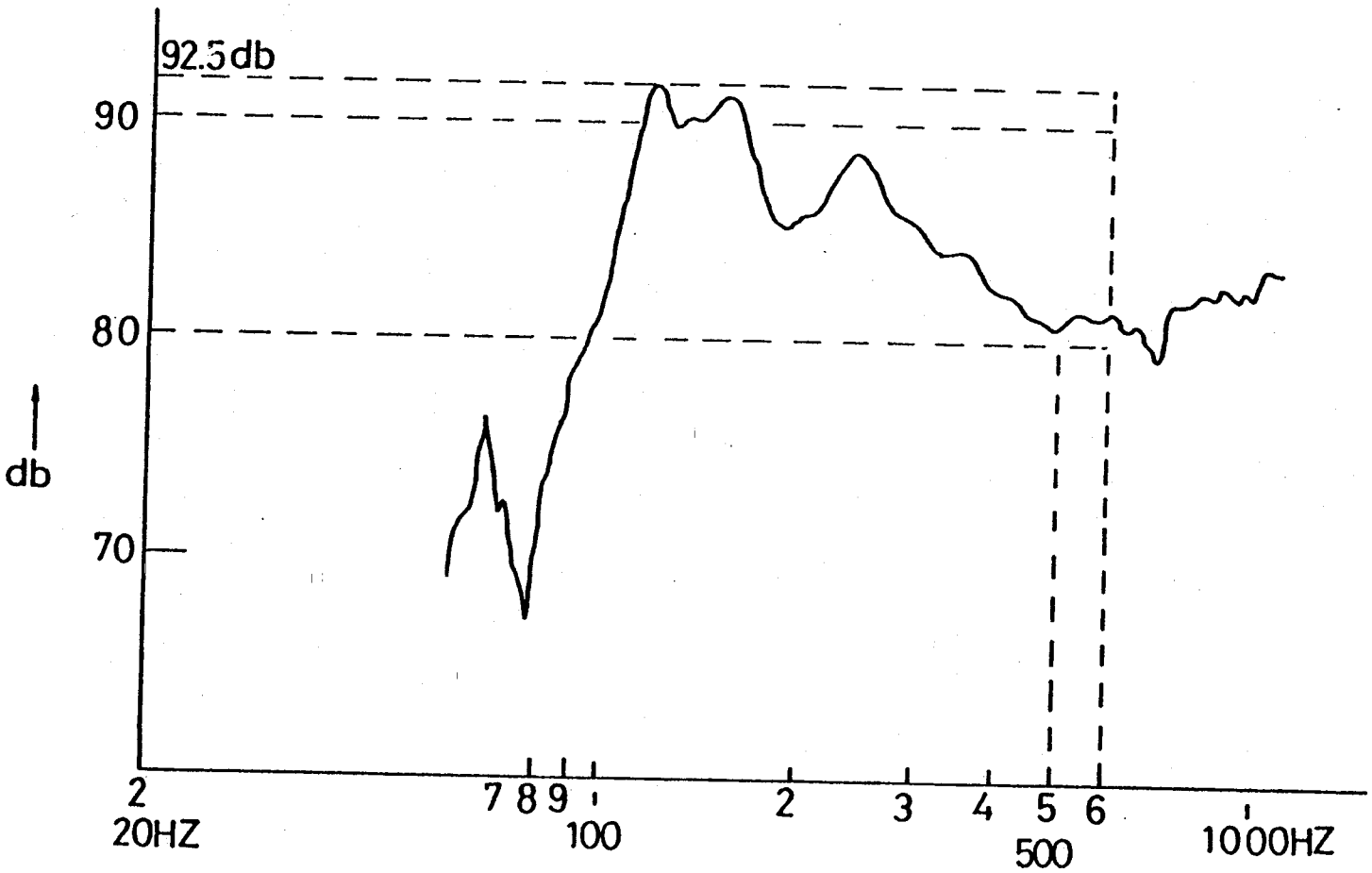
FIG. 3 is a characteristic curve from a test on a conventional low-frequency speaker.
Figure 4:
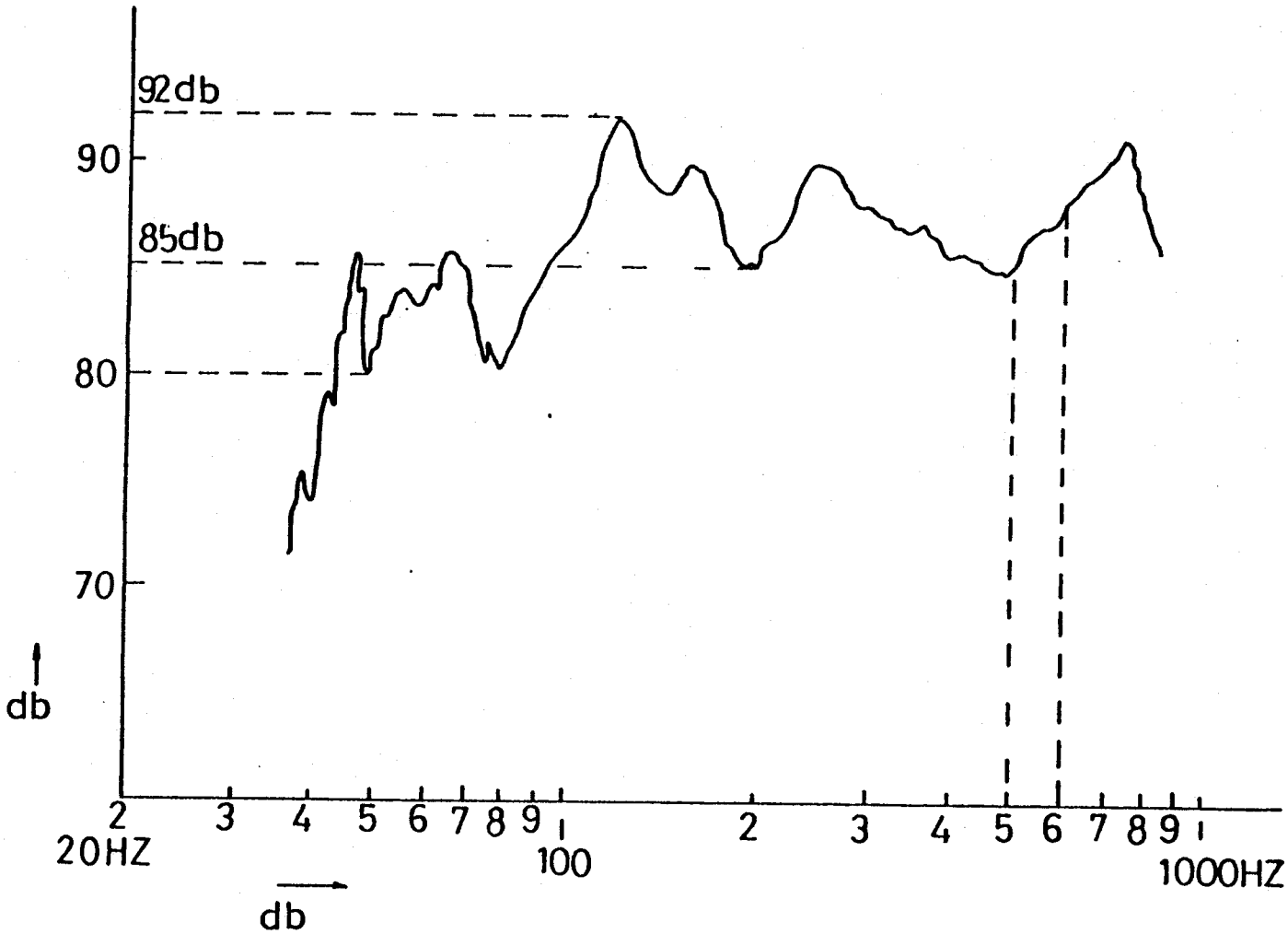
FIG. 4 is a characteristic curve from a test on the preferred embodiment according to the present invention.

Please refer to FIGS. 3 and 4 for a comparison between the present invention and the conventional low frequency speaker.

FIG. 3 is a characteristic curve of the performance of a conventional low frequency speaker with a resonant board having a height of 21 mm and a diameter of 4". At an effective bass of 80 dB, the lowest frequency is 95 Hz, and the difference is over 10 dB at a sound pressure range of 100–500 Hz.

FIG. 4 is a characteristic curve of the performance of the embodiment according to the present invention with a resonant board having a height of 3 mm and a diameter of 3¼". At an effective bass of 80 dB, the lowest frequency is 45 Hz, the difference is 6 dB at a sound pressure range of 100–500 Hz. The difference can be less than 4 dB if a mechanical means is used for its production.

A comparison between the speaker of with the present invention, a conventional speaker, and the cellular type speaker is as follows:

| Particular | (A) | (B) | (C) |
|---|---|---|---|
| Height | 1 | about ⅔ | about 1/6 |
| Difference of Sound Pressure Level | ± 5 dB | ± 2 dB | ± 2 dB |
| Cost | Low | High | Low |
| Production | Easy | Hard | Easy |
| Speaker Variability | Low | Medium | High |

-continued

| Particular | (A) | (B) | (C) |
|---|---|---|---|
| Asembly | Easy | Hard | Easy |

Notes:
(A) = Conventional speaker
(B) = Cellular speaker
(C) = The present invention As described above, the present invention is a resonant board which can be produced easily at low production cost, and it is very different from the conventional plane-surfaced board for it has a particular structure of transmission of sound energy. It is indeed a new and practical structure of resonant board.

As indicated, the structure herein may be variously embodied. Recognizing various modifications will be apparent, the scope hereof shall be deemed to be defined by the claims set forth below.

What is claimed is

1. A plane-surfaced wave out-diffusion triangular beam-typed resonance board comprising:

a resonant board body forming a wave structure with waves diffusing outwards from the center at close intervals and having straight away connections between peak and valley, the board body having a round hole at the center and an integral soft circular cavity at its external edge, and having sufficient strength to withstand an upward and downward vibratory force without deformation;

an upper board adhered to the top of the resonant board body forming said straight away connections and covering the entire waved portion;

a lower board adhered to the bottom of the resonant board body to cover the entire waved portion, and having a central hole with a size identical to the round hold at the center of the resonant board body; and a paper bobbin adhered to the round hole at the center of the resonant board body, and having a coil at an external surface of the bobbin to receive the upward and downward vibratory force resulting from action of a magnetic field.

2. A plane-surface waved out-diffusion triangular beam-typed resonant board as claimed in claim 1 wherein the resonant board body has a circular shape.

* * * * *